US009437151B2

(12) United States Patent
Guo et al.

(10) Patent No.: US 9,437,151 B2
(45) Date of Patent: Sep. 6, 2016

(54) SCAN DRIVING CIRCUIT AND DISPLAY PANEL

(71) Applicant: Shenzhen China Star Optoelectronics Technology Co., Ltd., Shenzhen, Guangdong (CN)

(72) Inventors: Jinbo Guo, Guangdong (CN); Jinjie Wang, Guangdong (CN); Caiqin Chen, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 81 days.

(21) Appl. No.: 14/396,052

(22) PCT Filed: Sep. 16, 2014

(86) PCT No.: PCT/CN2014/086645

§ 371 (c)(1),
(2) Date: Oct. 21, 2014

(87) PCT Pub. No.: WO2016/033830

PCT Pub. Date: Mar. 10, 2016

(65) Prior Publication Data

US 2016/0071474 A1 Mar. 10, 2016

(30) Foreign Application Priority Data

Sep. 4, 2014 (CN) ..... 2014 1 0448802

(51) Int. Cl.
*G09G 3/36* (2006.01)

(52) U.S. Cl.
CPC .... *G09G 3/3677* (2013.01); *G09G 2300/0426* (2013.01); *G09G 2310/08* (2013.01); *G09G 2320/0223* (2013.01)

(58) Field of Classification Search
CPC ..... G09G 3/2674–3/3681; G09G 2310/02–2310/0216; G09G 2310/0262; G09G 2310/0267; G09G 2310/0278–2310/0283; G09G 2310/062–2310/067
See application file for complete search history.

(56) References Cited

U.S. PATENT DOCUMENTS 5,648,790 A * 7/1997 Lee ..... G09G 3/3677 345/100
2007/0103346 A1* 5/2007 Liu ..... G09G 3/3674 341/50
2009/0079669 A1* 3/2009 Huang ..... G09G 3/3677 345/30

(Continued)

FOREIGN PATENT DOCUMENTS

CN 101408700 A 4/2009
CN 101561597 A 10/2009

(Continued)

*Primary Examiner* — Sanghyuk Park
(74) *Attorney, Agent, or Firm* — Andrew C. Cheng

(57) ABSTRACT

The present invention provides a scan driving circuit and display panel. The scan driving circuit comprises a plurality of scan driving units, each of which comprises a fan-out line, a plurality of switch sets, a plurality of control lines and a plurality of scan lines. The control lines are connected to at least one of the switches of each of the switch sets individually and the fan-out line is connected to the scan lines through the switch sets, such that the scan lines are turned on separately under control of the fan-out line and the control lines. By the above mentioned solution, the present invention drives a plurality of scan lines by one fan-out line such that an amount of the gate driving chips in the fan-out block and the layout space of the fan-out line can be reduced.

6 Claims, 4 Drawing Sheets

(56) References Cited

U.S. PATENT DOCUMENTS

2010/0001929 A1* 1/2010 Kawabe ..... G09G 3/3208 345/55
2010/0007643 A1* 1/2010 Wu ..... G09G 3/3677 345/211
2010/0039361 A1* 2/2010 Hsu ..... G09G 3/3677 345/92
2011/0316833 A1* 12/2011 Chang ..... G09G 3/3677 345/211
2013/0215089 A1* 8/2013 Wang ..... G09G 3/3677 345/204

FOREIGN PATENT DOCUMENTS

CN 101707047 A 5/2010
CN 101762915 A 6/2010

* cited by examiner

SCAN DRIVING CIRCUIT AND DISPLAY PANEL

FIELD OF THE INVENTION

The present invention relates to a technique field of liquid crystal display, and more particularly to a scan driving circuit and display panel.

BACKGROUND OF THE INVENTION

FIG. 1 is a structural schematic diagram of a display panel in the prior art. As shown in FIG. 1, each pixel in the display panel is controlled by a gate line and a data line. A display panel of which the resolution is M*N should have M scan lines Gn (n=1, 2, . . . , M) and 3N data lines Dn (n=1, 2, . . . , 3N).

As the resolution of the display panel getting higher, the amount of the gate line and the amount of the fan-out line corresponding to the gate lines increase as well. The amount of the gate IC corresponding to the fan-out lines is increased when the scan lines are driven by single gate driving method, such that the area occupied by the fan-out block of the display panel is increased and therefore the design of narrow bezel cannot be realized. Besides, the width of the fan-out line corresponding to each scan line would be reduced as the resolution of the display panel getting higher if the area of the fan-out block remains the same, such that the line width of the fan-out lines is so small that the problem of line broken or signal delay would be occurred.

SUMMARY OF THE INVENTION

The main technique problem solved by the present invention is to provide a scan driving circuit and display panel, which reduces an amount of the gate driving chips in the fan-out block and the layout space of the fan-out line such that the design of narrow bezel can be realized.

In order to solve the problem mentioned above, a technique solution adopted by the present invention is to provide a scan driving circuit, which comprises a plurality of scan driving units, wherein each of the scan driving units comprises a fan-out line, a plurality of switch sets, a plurality of control lines and a plurality of scan lines, and an amount of the switch sets, the amount of switches in each of the switch sets, the amount of the control lines and the amount of the scan lines are the same; the control lines are connected to at least one of the switches of each of the switch sets individually; the fan-out line is connected to the scan lines through the switch sets, and the switch sets are correspondence to the scan lines one-on-one, such that the scan lines are turned on separately under control of the fan-out line and the control lines; wherein, the switch sets comprises a first switch set and a second switch set, the first switch set comprises a first TFT switch and a second TFT switch, the second switch set comprises a third TFT switch and a fourth TFT switch, the control lines comprises a first control line and a second control line, and the scan lines comprises a first scan line and a second scan line; wherein, the first control line and the second control line of each of the scan driving units are connected.

Wherein, the control lines connecting to at least one of the switches of each of the switch sets individually is that the first control line is connected to a gate electrode of the first TFT switch and a source electrode of the second TFT switch, and the second control line is connected to a gate electrode of the second TFT switch; and the first control line is connected to a gate electrode of the fourth TFT switch, and the second control line is connected to a gate electrode of the third TFT switch and a source electrode of the fourth TFT switch.

In order to solve the problem mentioned above, another technique solution adopted by the present invention is to provide a scan driving circuit, which comprises a plurality of scan driving units, wherein each of the scan driving units comprises a fan-out line, a plurality of switch sets, a plurality of control lines and a plurality of scan lines, and an amount of the switch sets, the amount of switches in each of the switch sets, the amount of the control lines and the amount of the scan lines are the same; the control lines are connected to at least one of the switches of each of the switch sets individually; the fan-out line is connected to the scan lines through the switch sets, and the switch sets being correspondence to the scan lines one-on-one, such that the scan lines are turned on separately under control of the fan-out line and the control lines.

Wherein, the switch sets comprises a first switch set and a second switch set, the first switch set comprises a first TFT switch and a second TFT switch, the second switch set comprises a third TFT switch and a fourth TFT switch, the control lines comprises a first control line and a second control line, and the scan lines comprises a first scan line and a second scan line.

Wherein, the control lines connecting to at least one of the switches of each of the switch sets individually is that the first control line is connected to a gate electrode of the first TFT switch and a source electrode of the second TFT switch, and the second control line is connected to a gate electrode of the second TFT switch; and the first control line is connected to a gate electrode of the fourth TFT switch, and the second control line is connected to a gate electrode of the third TFT switch and a source electrode of the fourth TFT switch.

Wherein, the fan-out line connecting to the scan lines through the switch sets is that the fan-out line is connected to a source electrode of the first TFT switch, a drain electrode of the first TFT is connected to a drain electrode of the second TFT switch, and the drain electrode of the second TFT switch is connected to the first scan line; and the fan-out line is connected to a source electrode of the third TFT switch, a drain electrode of the third TFT switch is connected to a drain electrode of the fourth TFT switch, and the drain electrode of the fourth TFT switch is connected to the second scan line.

Wherein, when the fan-out line outputs a high level signal in a first clock cycle and a second clock cycle, the first control line outputs the high level signal in the first clock cycle and outputs a low level signal in the second clock cycle, and the second control line outputs the low level signal in the first clock cycle and outputs the high level signal in the second clock cycle, such that the first scan line is turned on in the first clock cycle and turned off in the second clock cycle, and the second scan line is turned off in the first clock cycle and turned on in the second clock cycle.

Wherein, the switch sets comprises a first switch set, a second switch set and a third switch set; the first switch set comprises a first TFT switch, a second TFT switch and a third TFT switch, the second switch set comprises a fourth TFT switch, a fifth TFT switch and a sixth TFT switch, the third switch set comprises a seventh TFT switch, an eighth TFT switch and a ninth TFT switch, the control lines comprises a first control line, a second control line and a third control line, and the scan lines comprises a first scan line, a second scan line and a third scan line.

Wherein, the control lines connecting to at least one of the switches of each of the switch sets individually is that the first control line is connected to a gate electrode of the first TFT switch and a source electrode of the second TFT switch, the second control line is connected to a gate electrode of the second TFT switch and a source electrode of the third TFT switch, and the third control line is connected to a gate electrode of the third TFT switch; the first control line is connected to a gate electrode of the fifth TFT switch, the second control line is connected to a gate electrode of the fourth TFT switch, a source electrode of the fifth TFT switch and a source electrode of the sixth TFT switch, and the third control line is connected to a gate electrode of the sixth TFT switch; and the first control line is connected to a gate electrode of the ninth TFT switch, the second control line is connected to a gate electrode of the eighth TFT switch, and the third control line is connected to a gate electrode of the seventh TFT switch, a source electrode of the eighth TFT switch and a source electrode of the ninth TFT switch.

Wherein, the fan-out line connecting to the scan lines through the switch sets is that the fan-out line is connected to a source electrode of the first TFT switch, a drain electrode of the first TFT switch is connected to a drain electrode of the second TFT switch, the drain electrode of the second TFT switch is connected to a drain electrode of the third TFT switch, and the drain electrode of the third TFT switch is connected to the first scan line; the fan-out line is connected to a source electrode of the fourth TFT switch, a drain electrode of the fourth TFT switch is connected to a drain electrode of the fifth TFT switch, the drain electrode of the fifth TFT switch is connected to a drain electrode of the sixth TFT switch, and the drain electrode of the sixth TFT switch is connected to the second scan line; and the fan-out line is connected to a source electrode of the seventh TFT switch, a drain electrode of the seventh TFT switch is connected to a drain electrode of the eighth TFT switch, the drain electrode of the eighth TFT switch is connected to a drain electrode of the ninth TFT switch, and the drain electrode of the ninth TFT switch is connected to the third scan line.

Wherein, when the fan-out line outputs a high level signal in a first clock cycle, a second clock cycle and a third clock cycle, the first control line outputs the high level signal in the first clock cycle and outputs a low level signal in the second and third clock cycles, the second control line outputs the low level signal in the first and third clock cycles and outputs the high level signal in the second clock cycle, and the third control line outputs the low level signal in the first and second clock cycles and outputs the high level signal in the third clock cycle, such that the first scan line is turned on in the first clock cycle and turned off in the second and third clock cycles, the second scan line is turned off in the first clock cycle, turned on in the second clock cycle and turned off in the third clock cycle, and the third scan line is turned off in the first and second clock cycles and turned on in the third clock cycle.

In order to solve the problem mentioned above, the solution further adopted by the present invention is to provide a display panel comprising a plurality of gate driving chips and a scan driving circuit, wherein the scan driving circuit comprises a plurality of scan driving units, wherein each of the scan driving units comprises a fan-out line, a plurality of switch sets, a plurality of control lines and a plurality of scan lines, and an amount of the switch sets, the amount of switches in each of the switch sets, the amount of the control lines and the amount of the scan lines are the same; the control lines are connected to at least one of the switches of each of the switch sets individually; the fan-out line is connected to the scan lines through the switch sets, and the switch sets are correspondence to the scan lines one-on-one, such that the scan lines are turned on separately under control of the fan-out line and the control lines; the gate driving chips are connected to the fan-out lines of the scan driving units individually, and the gate driving chips are correspondence to the fan-out lines one-on-one.

Wherein, the switch sets comprises a first switch set and a second switch set, the first switch set comprises a first TFT switch and a second TFT switch, the second switch set comprises a third TFT switch and a fourth TFT switch, the control lines comprises a first control line and a second control line, and the scan lines comprises a first scan line and a second scan line.

Wherein, the control lines connecting to at least one of the switches of each of the switch sets individually is that the first control line is connected to a gate electrode of the first TFT switch and a source electrode of the second TFT switch, and the second control line is connected to a gate electrode of the second TFT switch; and the first control line is connected to a gate electrode of the fourth TFT switch, and the second control line is connected to a gate electrode of the third TFT switch and a source electrode of the fourth TFT switch.

Wherein, the fan-out line connecting to the scan lines through the switch sets is that the fan-out line is connected to a source electrode of the first TFT switch, a drain electrode of the first TFT is connected to a drain electrode of the second TFT switch, and the drain electrode of the second TFT switch is connected to the first scan line; and the fan-out line is connected to a source electrode of the third TFT switch, a drain electrode of the third TFT switch is connected to a drain electrode of the fourth TFT switch, and the drain electrode of the fourth TFT switch is connected to the second scan line.

Wherein, when the fan-out line outputs a high level signal in a first clock cycle and a second clock cycle, the first control line outputs the high level signal in the first clock cycle and outputs a low level signal in the second clock cycle, and the second control line outputs the low level signal in the first clock cycle and outputs the high level signal in the second clock cycle, such that the first scan line is turned on in the first clock cycle and turned off in the second clock cycle, and the second scan line is turned off in the first clock cycle and turned on in the second clock cycle.

Wherein, the switch sets comprises a first switch set, a second switch set and a third switch set; the first switch set comprises a first TFT switch, a second TFT switch and a third TFT switch, the second switch set comprises a fourth TFT switch, a fifth TFT switch and a sixth TFT switch, the third switch set comprises a seventh TFT switch, an eighth TFT switch and a ninth TFT switch, the control lines comprises a first control line, a second control line and a third control line, and the scan lines comprises a first scan line, a second scan line and a third scan line.

Wherein, the control lines connecting to at least one of the switches of each of the switch sets individually is that the first control line is connected to a gate electrode of the first TFT switch and a source electrode of the second TFT switch, the second control line is connected to a gate electrode of the second TFT switch and a source electrode of the third TFT switch, and the third control line is connected to a gate electrode of the third TFT switch; the first control line is connected to a gate electrode of the fifth TFT switch, the second control line is connected to a gate electrode of the fourth TFT switch, a source electrode of the fifth TFT switch and a source electrode of the sixth TFT switch, and the third control line is connected to a gate electrode of the sixth TFT switch; and the first control line is connected to a gate electrode of the ninth TFT switch, the second control line is connected to a gate electrode of the eighth TFT switch, and the third control line is connected to a gate electrode of the seventh TFT switch, a source electrode of the eighth TFT switch and a source electrode of the ninth TFT switch.

Wherein, the fan-out line connecting to the scan lines through the switch sets is that the fan-out line is connected to a source electrode of the first TFT switch, a drain electrode of the first TFT switch is connected to a drain electrode of the second TFT switch, the drain electrode of the second TFT switch is connected to a drain electrode of the third TFT switch, and the drain electrode of the third TFT switch is connected to the first scan line; the fan-out line is connected to a source electrode of the fourth TFT switch, a drain electrode of the fourth TFT switch is connected to a drain electrode of the fifth TFT switch, the drain electrode of the fifth TFT switch is connected to a drain electrode of the sixth TFT switch, and the drain electrode of the sixth TFT switch is connected to the second scan line; and the fan-out line is connected to a source electrode of the seventh TFT switch, a drain electrode of the seventh TFT switch is connected to a drain electrode of the eighth TFT switch, the drain electrode of the eighth TFT switch is connected to a drain electrode of the ninth TFT switch, and the drain electrode of the ninth TFT switch is connected to the third scan line.

Wherein, when the fan-out line outputs a high level signal in a first clock cycle, a second clock cycle and a third clock cycle, the first control line outputs the high level signal in the first clock cycle and outputs a low level signal in the second and third clock cycles, the second control line outputs the low level signal in the first and third clock cycles and outputs the high level signal in the second clock cycle, and the third control line outputs the low level signal in the first and second clock cycles and outputs the high level signal in the third clock cycle, such that the first scan line is turned on in the first clock cycle and turned off in the second and third clock cycles, the second scan line is turned off in the first clock cycle, turned on in the second clock cycle and turned off in the third clock cycle, and the third scan line is turned off in the first and second clock cycles and turned on in the third clock cycle.

The beneficial effect of the present invention is: different from the conventional technique, the scan driving circuit and the display panel of the present invention drives a plurality of scan lines by one fan-out line through connecting the control lines at least one of the switches of each of the switch sets individually, and connecting the fan-out line to the scan lines through the switch sets, so as to turn on the scan lines separately under control of the fan-out line and the control lines, such that an amount of the gate driving chips in the fan-out block and the layout space of the fan-out line can be reduced, and therefore the design of a narrow bezel display panel could be reached.

DETAILED DESCRIPTION OF PREFERRED EMBODIMENTS

Those who skilled in the field should know that, while some terms being used to identify certain elements in the Specification and Claims, the same elements might be named as other terms by the manufacturers. The elements in the Specification and Claims are distinguished basing on different functionality but not different name. The present invention is described in detail below by referring to the attached drawings and the embodiments.

Figure 1:
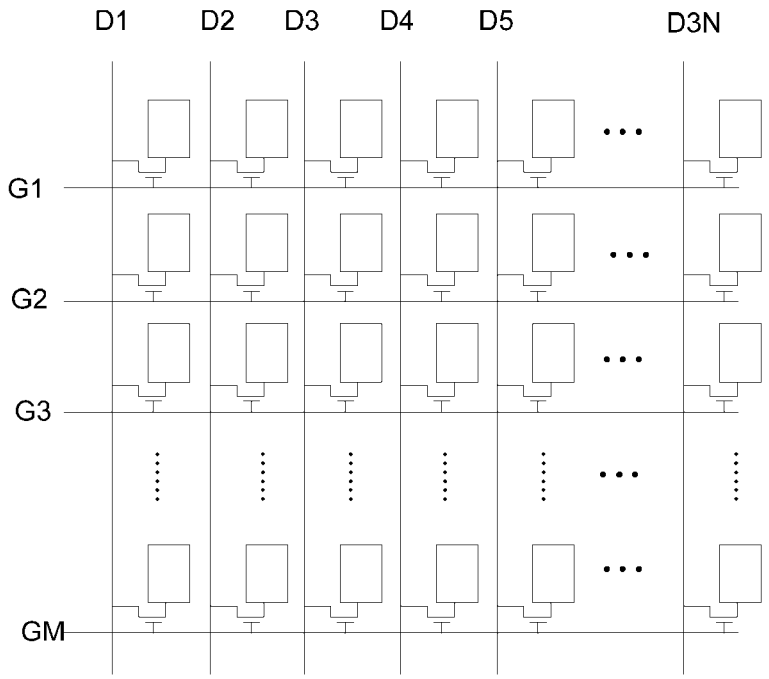
FIG. 1(Prior Art)
FIG. 1 is a structure schematic diagram of a conventional display panel.
Figure 2:
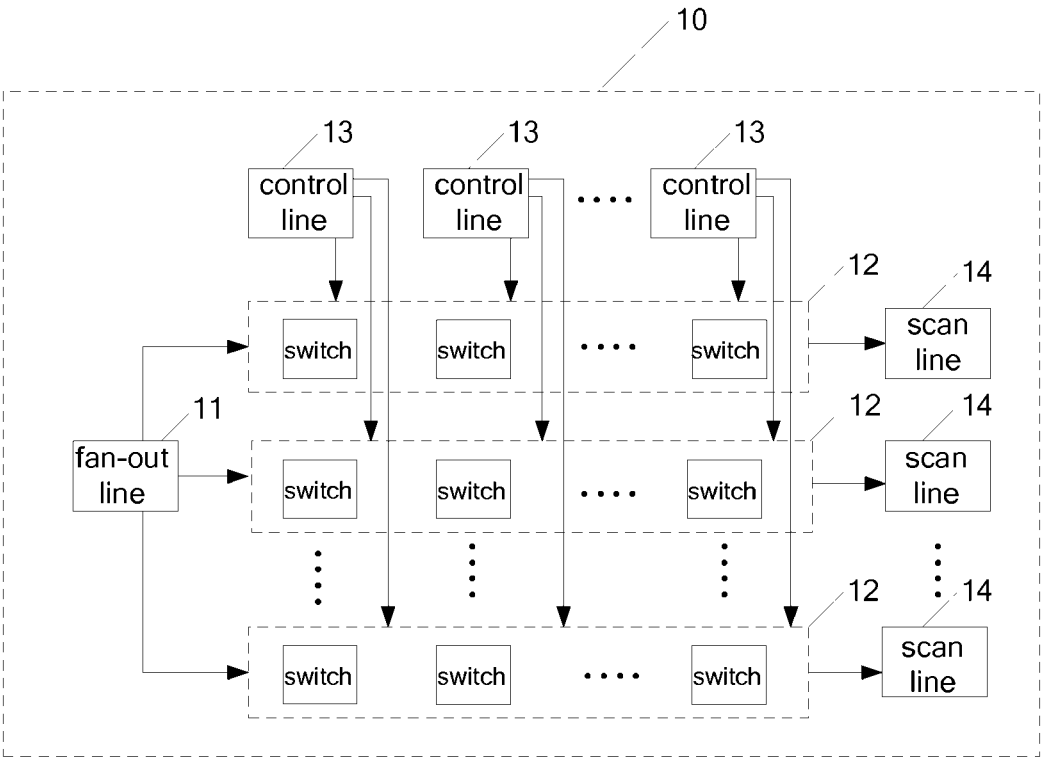
FIG. 2 is a structure schematic diagram of a scan driving circuit according to the first embodiment of the present invention.

FIG. 2 is a structure schematic diagram of a scan driving circuit according to the first embodiment of the present invention. As shown in FIG. 2, the scan driving circuit comprises a plurality of scan driving units 10. Each of the scan driving units 10 comprises a fan-out line 11, a plurality of switch sets 12, a plurality of control lines 13 and a plurality of scan lines 14, wherein an amount of the switch sets 12, the amount of switches in each of the switch sets 12, the amount of the control lines 13 and the amount of the scan lines 14 are the same. Wherein, the control line 13 in each of the scan driving units 10 is connected to each other.

The control lines 13 are connected to at least one of the switches of each of the switch sets 12 individually; the fan-out line 11 is connected to the scan lines 14 through the switch sets 12, such that the scan lines 14 are turned on separately under control of the fan-out line 11 and the control lines 13. Wherein, the switch sets 12 are correspondence to the scan lines 14 one-on-one.

Figure 3:
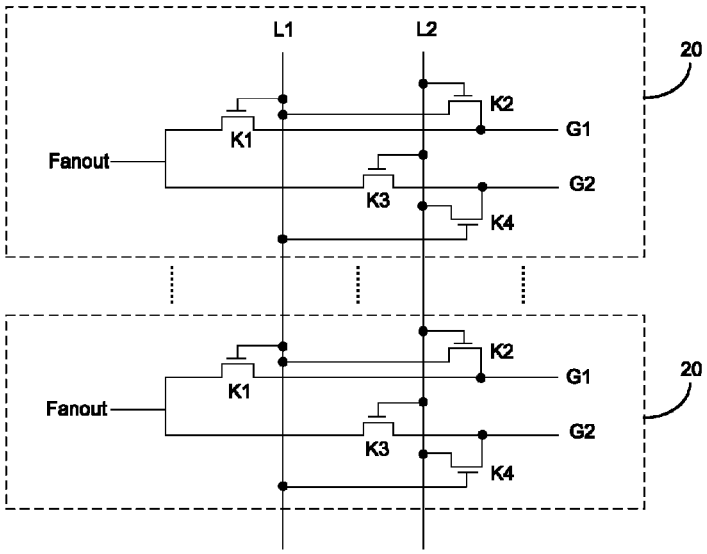
FIG. 3 is a circuit diagram of a scan driving circuit according to the second embodiment of the present invention.

FIG. 3 is a circuit diagram of a scan driving circuit according to the second embodiment of the present invention. As shown in FIG. 3, the scan driving circuit comprises a plurality of scan driving units 20, and each scan driving unit 20 comprises a fan-out line Fanout, a first TFT switch K1, a second TFT switch K2, a third TFT switch K3, a fourth TFT switch K4, a first control line L1, a second control line L2, a first scan line G1 and a second scan line G2.

Wherein, the amount of the switch sets, the amount of switches in each of the switch sets, the amount of the control lines and the amount of the scan lines are the same, i.e., 2.

Wherein, a first switch set is formed by the first TFT switch K1 and the second TFT switch K2, and a second switch set is formed by the third TFT switch K3 and the fourth TFT switch K4.

In the first switch set, the first control line L1 is connected to a gate electrode of the first TFT switch K1 and a source electrode of the second TFT switch K2, and the second control line L2 is connected to a gate electrode of the second TFT switch K2; the fan-out line Fanout is connected to a source electrode of the first TFT switch K1, a drain electrode of the first TFT switch K1 is connected to a drain electrode of the second TFT switch K2, and the drain electrode of the second TFT switch K2 is connected to the first scan line G1.

In the second switch set, the first control line L1 is connected to a gate electrode of the fourth TFT switch K4, and the second control line L2 is connected to a gate electrode of the third TFT switch K3 and a source electrode of the fourth TFT switch K4; the fan-out line Fanout is connected to a source electrode of the third TFT switch K3, a drain electrode of the third TFT switch K3 is connected to a drain electrode of the fourth TFT switch K4, and the drain electrode of the fourth TFT switch K4 is connected to the second scan line G2.

Figure 4:
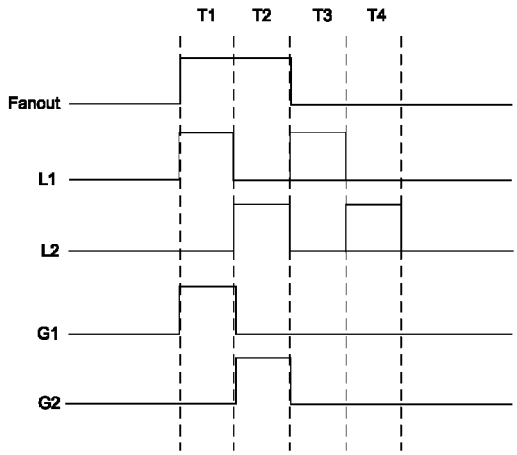
FIG. 4 is a waveform diagram of the scan driving unit shown in FIG. 3.

Please also refer to FIG. 4, wherein FIG. 4 is a waveform diagram of the scan driving unit shown in FIG. 3. As shown in FIG. 4, in the scan driving unit 20, the fan-out line Fanout outputs a high level signal in a first clock cycle T1 and a second clock cycle T2, the first control line L1 outputs the high level signal in the first clock cycle T1 and outputs a low level signal in the second clock cycle T2, and the second control line L2 outputs the low level signal in the first clock cycle T1 and outputs the high level signal in the second clock cycle T2.

In the first clock cycle T1, since the first control line L1 outputs the high level signal and the second control line L2 outputs the low level signal, the first TFT switch K1 and the fourth TFT switch K4 is turned on, i.e., the source electrode and the drain electrode of the first TFT switch K1 is conducted and the source electrode and the drain electrode of the fourth TFT switch K4 is conducted; the second TFT switch K2 and the third TFT switch K3 is turned off, i.e., the source electrode and the drain electrode of the second TFT switch K2 is cutoff and the source electrode and the drain electrode of the third TFT switch K3 is cutoff. Wherein, when the first TFT switch K1 is turned on, the first scan line G1 connecting to the drain electrode of the first TFT switch K1 outputs the high level signal, i.e., the first scan line G1 is turned on because the source electrode of the first TFT switch K1 is connected to the fan-out line Fanout and the fan-out line Fanout outputs the high level signal in the first clock cycle T1. When the fourth TFT switch K4 is turned on, the second scan line G2 connecting to the drain electrode of the fourth TFT switch K4 outputs the low level signal, i.e., the second scan line G2 is turned off because the source electrode of the fourth TFT switch K4 is connected to the second control line L2 and the second control line L2 outputs the low level signal in the first clock cycle T1.

In the second clock cycle T2, since the first control line L1 outputs the low level signal and the second control line L2 outputs the high level signal, the first TFT switch K1 and the fourth TFT switch K4 is turned off and the second TFT switch K2 and the third TFT switch K3 is turned on. Wherein, when the second TFT switch K2 is turned on, the first scan line G1 connecting to the drain electrode of the second TFT switch K2 outputs the low level signal, i.e., the first scan line G1 is turned off because the source electrode of the second TFT switch K2 is connected to the first control line L1 and the first control line L1 outputs the low level signal in the second clock cycle T2. When the third TFT switch K3 is turned on, the second scan line G2 connecting to the drain electrode of the third TFT switch K3 outputs the high level signal, i.e., the second scan line G2 is turned on because the source electrode of the third TFT switch K3 is connected to the fan-out line Fanout and the fan-out line Fanout outputs the high level signal in the second clock cycle T2.

After that, the fan-out line Fanout of the scan driving unit 20 is set to output the low level signal in the third clock cycle T3 and the fourth clock cycle T4. The signal status of the first control line L1 in the first clock cycle T1 and the second clock cycle T2 is repeated, i.e., the first control line L1 outputs the high level signal in the third clock cycle T3 and outputs the low level signal in the fourth clock cycle T4. The signal status of the second control line L2 in the first clock cycle T1 and the second clock cycle T2 is repeated, i.e., the second control line L2 outputs the low level signal in the third clock cycle T3 and outputs the high level signal in the fourth clock cycle T4. Therefore, the first scan line G1 and the second scan line G2 both output the low level signals, i.e., the first scan line G1 and the second scan line G2 are both turned off.

When the scan driving circuit comprises a plurality of scan driving units 20, the fan-out lines Fanout of the scan driving units 20 are set to output the high level signal for two clock cycles sequentially, and the first control line L1 is set to output the high level signal followed by the low level signal in the two clock cycles, the second control line L2 is set to output the low level signal followed by the high level signal in the two clock cycles, and the fan-out line outputting the high level signal is switched every two clock cycles, such that the scan lines in the scan driving circuit can be turned on separately. Specifically, for the example of two scan driving units 20 and four clock cycles, the fan-out line Fanout of the first scan driving unit 20 is set to output the high level signal in the first and second clock cycles, and is set to output the low level signal in the third and fourth clock cycles; the fan-out line Fanout of the second drive scanning unit 20 is set to output the low level signal in the first and second clock cycles, and is set to output the high level signal in the third and fourth clock cycles. At the same time, the first control line L1 is set to output the high level signal in the first clock cycle, the low level signal in the second clock cycle, the high level signal in the third clock cycle, and the low level signal in the fourth clock cycle; and the second control line L2 is set to output the low level signal in the first clock cycle, the high level signal in the second clock cycle, the low level signal in the third clock cycle, and the high level signal in the fourth clock cycle. Therefore, only the first scan line G1 in the first scan driving unit 20 outputs the high signal level in the first clock cycle, only the second scan line G2 in the first scan driving unit 20 outputs the high level signal in the second clock cycle, only the first scan line G1 in the second scan driving unit 20 outputs the high level signal in the third clock cycle, and only the second scan line G2 in the second scan driving unit 20 outputs the high level signal in the fourth clock cycle, such that the four scan lines in the scan driving circuit are turned on separately.

Figure 5:
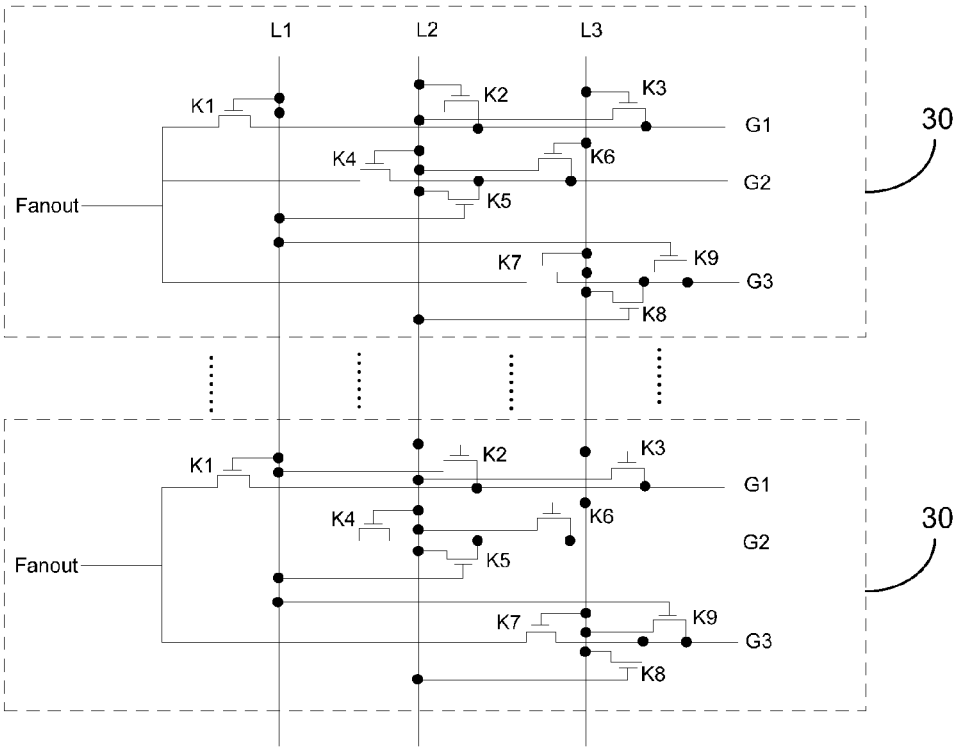
FIG. 5 is a circuit diagram of a scan driving circuit according to the third embodiment of the present invention.

FIG. 5 is a circuit diagram of a scan driving circuit according to the third embodiment of the present invention. As shown in FIG. 5, the scan driving circuit comprises a plurality of scan driving units 30. Each scan driving unit 30 comprises a fan-out line Fanout, a first TFT switch K1, a second TFT switch K2, a third TFT switch K3, a fourth TFT switch K4, a fifth TFT switch K5, a sixth TFT switch K6, a seventh TFT switch K7, an eighth TFT switch K8, a ninth TFT switch K9, a first control line L1, a second control line L2, a third control line L3, a first scan line G1, a second scan line G2 and a third scan line G3. Wherein, the first control lines L1 in every scan driving unit 30 is connected to each other, the second control line L2 in every scan driving unit 30 is connected to each other, and the third control line L3 in every scan driving unit 30 is connected to each other.

Wherein, the amount of the switch sets, the amount of the switches in each of the switch sets, the amount of the control lines and the amount of the scan lines are the same, i.e., 3.

Wherein, the first switch set is formed by the first TFT switch K1, the second TFT switch K2 and the third TFT switch K3, the second switch set is formed by the fourth TFT switch K4, the fifth TFT switch K5 and the sixth TFT switch K6, and the third switch set is formed by the seventh TFT switch K7, the eighth TFT switch K8 and the ninth TFT switch K9.

In the first switch set, the first control line L1 is connected to a gate electrode of the first TFT switch K1 and a source electrode of the second TFT switch K2, the second control line L2 is connected to a gate electrode of the second TFT switch K2 and a source electrode of the third TFT switch K3, and the third control line L3 is connected to a gate electrode of the third TFT switch K3; and the fan-out line Fanout is connected to a source electrode of the first TFT switch K1, a drain electrode of the first TFT switch K1 is connected to a drain electrode of the second TFT switch K2, the drain electrode of the second TFT switch K2 is connected to a drain electrode of the third TFT switch K3, and the drain electrode of the third TFT switch K3 is connected to the first scan line G1.

In the second switch set, the first control line L11 is connected to a gate electrode of the fifth TFT switch K5, the second control line L2 is connected to a gate electrode of the fourth TFT switch K4, a source electrode of the fifth TFT switch K5 and a source electrode of the sixth TFT switch K6, and the third control line L3 is connected to a gate electrode of the sixth TFT switch K6; and the fan-out line Fanout is connected to a source electrode of the fourth TFT switch K4, a drain electrode of the fourth TFT switch K4 is connected to a drain electrode of the fifth TFT switch K5, the drain electrode of the fifth TFT switch K5 is connected to a drain electrode of the sixth TFT switch K6, and the drain electrode of the sixth TFT switch K6 is connected to the second scan line G2.

In the third switch set, the first control line L1 is connected to a gate electrode of the ninth TFT switch K9, the second control line L2 is connected to a gate electrode of the eighth TFT switch K8, and the third control line L3 is connected to a gate electrode of the seventh TFT switch K7, a source electrode of the eighth TFT switch K8 and a source electrode of the ninth TFT switch K9; and the fan-out line Fanout is connected to a source electrode of the seventh TFT switch K7, a drain electrode of the seventh TFT switch K7 is connected to a drain electrode of the eighth TFT switch K8, the drain electrode of the eighth TFT switch K8 is connected to a drain electrode of the ninth TFT switch K9, and the drain electrode of the ninth TFT switch K9 is connected to the third scan line G3.

Figure 6:
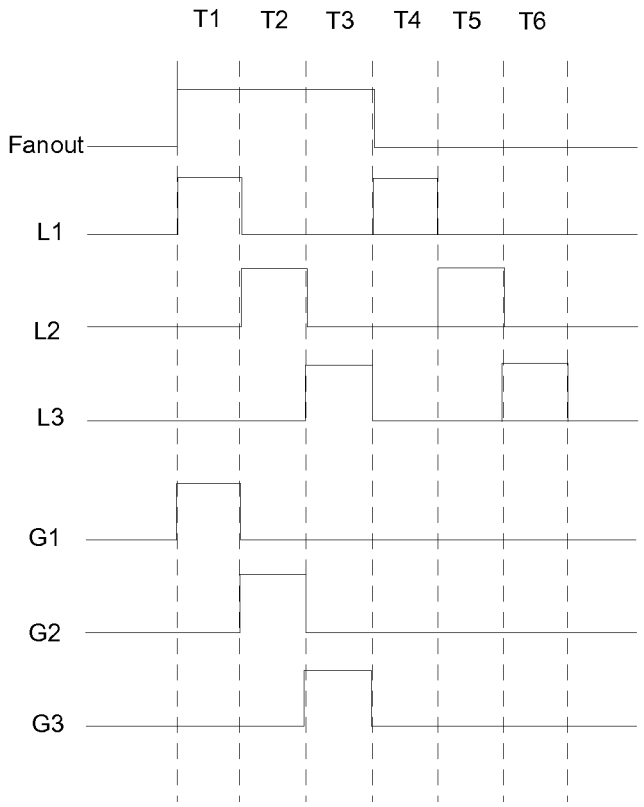
FIG. 6 is a waveform diagram of the scan driving unit shown in FIG. 5.

Please also refer to FIG. 6, wherein FIG. 6 is a waveform diagram of the scan driving unit shown in FIG. 5. As shown in FIG. 6, in the scan driving unit 30, the fan-out line Fanout outputs a high level signal in a first clock cycle T1, a second clock cycle T2 and a third clock cycle T3, the first control line L1 outputs the high level signal in the first clock cycle T1 and outputs a low level signal in the second clock cycle T2 and the third clock cycle T3, the second control line L2 outputs the high level signal in the second clock cycle T2, and outputs the low level signal in the first clock cycle T1 and the third clock cycle T3, and the third control line L3 outputs the high level signal in the third clock cycle T3, and outputs the low level signal in the first clock cycle T1 and the second clock cycle T2.

In the first clock cycle T1, the first TFT switch K1, the fifth TFT switch K5 and the ninth TFT switch K9 are turned on and the second TFT switch K2, the third TFT switch K3, the fourth TFT switch K4, the sixth TFT switch K6, the seventh TFT switch K7 and the eighth TFT switch K8 are turned off because the first control line L1 outputs the high level signal, the second control line L2 outputs the low level signal and the third control line L3 outputs the low level signal. Wherein, when the first TFT switch K1 is turned on, the first scan line G1 connected to the drain electrode of the first TFT switch K1 outputs the high level signal, i.e., the first scan line G1 is turned on because the source electrode of the first TFT switch K1 is connected to the fan-out line Fanout, and the fan-out line Fanout outputs the high level signal in the first clock cycle T1. When the fifth TFT switch K5 is turned on, the second scan line G2 connected to the drain electrode of the fifth TFT switch K5 outputs the low level signal, i.e., the second scan line G2 is turned off because the source electrode of the fifth TFT switch K5 is connected to the second control line L2, and the second control line L2 outputs the low level signal in the first clock cycle T1. When the ninth TFT switch K9 is turned on, the third scan line G3 connected to the drain electrode of the ninth TFT switch K9 outputs the low level signal, i.e., the third scan line G3 is turned off because the source electrode of the ninth TFT switch K9 is connected to the third control line L3, and the third control line L3 outputs the low level signal in the first clock cycle T1.

In the second clock cycle T2, the second TFT switch K2, the fourth TFT switch K4 and the eighth TFT switch K8 are turned on and the first TFT switch K1, the third TFT switch K3, the fifth TFT switch K5, the sixth TFT switch K6, the seventh TFT switch K7 and the ninth TFT switch K9 are turned off because the first control line L1 outputs the low level signal, the second control line L2 outputs the high level signal and the third control line L3 outputs the low level signal. Wherein, when the second TFT switch K2 is turned on, the first scan line G1 connected to the drain electrode of the second TFT switch K2 outputs the low level signal, i.e., the first scan line G1 is turned off because the source electrode of the second TFT switch K2 is connected to the first control line L1, and the first control line L1 outputs the low level signal in the second clock cycle T2. When the fourth TFT switch K4 is turned on, the second scan line G2 connected to the drain electrode of the fourth TFT switch K4 outputs the high level signal, i.e., the second scan line G2 is turned on because the source electrode of the fourth TFT switch K4 is connected to the fan-out line Fanout, and the fan-out line Fanout outputs the high level signal in the second clock cycle T2. When the eighth TFT switch K8 is turned on, the third scan line G3 connected to the drain electrode of the eighth TFT switch K8 outputs the low level signal, i.e., the third scan line G3 is turned off because the source electrode of the eighth TFT switch K8 is connected to the third control line L3, and the third control line L3 outputs the low level signal in the second clock cycle T2.

In the third clock cycle T3, the third TFT switch K3, the sixth TFT switch K6 and the seventh TFT switch K7 are turned on and the first TFT switch K1, the second TFT switch K2, the fourth TFT switch K4, the fifth TFT switch K5, the eighth TFT switch K8 and the ninth TFT switch K9 are turned off because the first control line L1 outputs the low level signal, the second control line L2 outputs the low level signal and the third control line L3 outputs the high level signal. Wherein, when the third TFT switch K3 is turned on, the first scan line G1 connected to the drain electrode of the third TFT switch K3 outputs the low level signal, i.e., the first scan line G1 is turned off because the source electrode of the third TFT switch K3 is connected to the second control line L2, and the second control line L2 outputs the low level signal in the third clock cycle T3. When the sixth TFT switch K6 is turned on, the second scan line G2 connected to the drain electrode of the sixth TFT switch K6 outputs the low level signal, i.e., the second scan line G2 is turned off because the source electrode of the sixth TFT switch K6 is connected to the second control line L2, and the second control line L2 outputs the low level signal in the third clock cycle T3. When the seventh TFT switch K7 is turned on, the third scan line G3 connected to the drain electrode of the seventh TFT switch K7 outputs the high level signal, i.e., the third scan line G3 is turned on because the source electrode of the seventh TFT switch K7 is connected to the fan-out line Fanout, and the fan-out line Fanout outputs the high level signal in the third clock cycle T3.

After that, the fan-out line Fanout of the scan driving unit 30 is set to output the low level signal in the fourth clock cycle T4, the fifth clock cycle T5 and the sixth clock cycle T6. The signal status of the first control line L1 in the first clock cycle T1, the second clock cycle T2 and the third clock cycle T3 is repeated, i.e., the first control line L1 outputs the high level signal in the fourth clock cycle T4 and outputs the low level signal in the fifth clock cycle T5 and the sixth clock cycle T6. The signal status of the second control line L2 in the first clock cycle T1, the second clock cycle T2 and the third clock cycle T3 is repeated, i.e., the second control line L2 outputs the high level signal in the fifth clock cycle T5 and outputs the low level signal in the fourth clock cycle T4 and the sixth clock cycle T6. The signal status of the third control line L3 in the first clock cycle T1, the second clock cycle T2 and the third clock cycle T3 is repeated, i.e., the third control line L3 outputs the high level signal in the sixth clock cycle T6 and outputs the low level signal in the fourth clock cycle T4 and the fifth clock cycle T5. Therefore, the first scan line G1, the second scan line G2 and the third scan line G3 output the low level signals in the fourth clock cycle T4, the fifth clock cycle T5 and the sixth clock cycle T6, i.e., the first scan line G1, the second scan line G2 and the third scan line G3 are turned off at the same time.

When the scan driving circuit comprises a plurality of scan driving units 30, the fan-out lines Fanout of the scan driving units 30 are set to output the high level signal for three clock cycles sequentially, and the first control line L1 is set to output the high level signal followed by the low level signal for two clock cycles in the three clock cycles, the second control line L2 is set to output the low level signal followed by the high level signal further followed by the low level signal, the third control line L3 is set to output the low level signal for two clock cycles followed by the high level signal, and the fan-out line outputting the high level signal is switched every three clock cycles, such that the scan lines in the scan driving circuit can be turned on separately. Specifically, for the example of two scan driving units 30 and six clock cycles, the fan-out line Fanout of the first scan driving unit 30 is set to output the high level signal in the first, second and third clock cycles, and is set to output the low level signal in the fourth, fifth and sixth clock cycles; the fan-out line Fanout of the second drive scanning unit 30 is set to output the low level signal in the first, second and third clock cycles, and is set to output the high level signal in the fourth, fifth and sixth clock cycles. At the same time, the first control line L1 is set to output the high level signal in the first clock cycle, the low level signal in the second clock cycle and the low level signal in the third clock cycle, and the output level status in the first to third clock cycles is repeated as the output level status in the fourth to sixth clock cycles; the second control line L2 is set to output the low level signal in the first clock cycle, the high level signal in the second clock cycle and the low level signal in the third clock cycle, and the output level status in the first to third clock cycles is repeated as the output level status in the fourth to sixth clock cycles; and the third control line L3 is set to output the low level signal in the first clock cycle, the low level signal in the second clock cycle and the high level signal in the third clock cycle, and the output level status in the first to third clock cycles is repeated as the output level status in the fourth to sixth clock cycles. Therefore, only the first scan line G1 in the first scan driving unit 30 outputs the high signal level in the first clock cycle, only the second scan line G2 in the first scan driving unit 30 outputs the high level signal in the second clock cycle, only the third scan line G3 in the first scan driving unit 30 outputs the high level signal in the third clock cycle, only the first scan line G1 in the second scan driving unit 30 outputs the high level signal in the fourth clock cycle, only the second scan line G2 in the second scan driving unit 30 outputs the high level signal in the fifth clock cycle, and only the third scan line G3 in the second scan driving unit 30 outputs the high level signal in the sixth clock cycle, such that the six scan lines in the scan driving circuit are turned on separately.

Those skilled in the technique field could note that based on the similar theory of the examples of driving two scan lines and three scan lines by one fan-out line described in the second embodiment shown in FIG. 3 and in the third embodiment shown in FIG. 5, the technique of driving four or more scan lines by one fan-out line should be within the protected scope of the present invention. Besides, the source electrode and the drain electrode of the TFT switches functioning under status of turning on or off in the second embodiment shown in FIG. 3 or the third embodiment shown in FIG. 5 could be exchanged and then fitted into the scan driving circuit, such that the present invention is not limited thereto.

The present invention further provides a display panel, which comprises a plurality of gate driving chips and the scan driving circuit described above, wherein the gate driving chips are connected to the fan-out lines of the scan driving units individually, and the gate driving chips are correspondence to the fan-out lines one-on-one.

The beneficial effect of the present invention is: different from the conventional technique, the scan driving circuit and the display panel of the present invention drives a plurality of scan lines by one fan-out line through connecting the control lines at least one of the switches of each of the switch sets individually, and connecting the fan-out line to the scan lines through the switch sets, so as to turn on the scan lines separately under control of the fan-out line and the control lines, such that an amount of the gate driving chips in the fan-out block and the layout space of the fan-out line can be reduced, and therefore the design of a narrow bezel display panel could be reached.

Those mentioned above are the embodiments of the present invention but not limitations on the claimed scope of the present invention. The variation of equivalent structure or equivalent procedure basing on the contents of the Specification and attached drawings of the present invention, or application of the contents of the Specification and attached drawings of the present invention directly or indirectly on other related technique field, should be included in the protection scope of the present invention.

What is claimed is:

1. A scan driving circuit, comprising:

a plurality of scan driving units, wherein each of the scan driving units comprises a fan-out line, a plurality of switch sets, a plurality of control lines and a plurality of scan lines, and an amount of the switch sets, an amount of switches in each of the switch sets, an amount of the control lines and an amount of the scan lines are the same;

the control lines connecting to at least one of the switches of each of the switch sets individually;

the fan-out line connecting to the scan lines through the switch sets, and the switch sets being correspondence to the scan lines one-on-one, such that the scan lines are turned on separately under control of the fan-out line and the control lines, wherein the switch sets comprise a first switch set, a second switch set and a third switch set; the first switch set comprises a first TFT switch, a second TFT switch and a third TFT switch, the second switch set comprises a fourth TFT switch, a fifth TFT switch and a sixth TFT switch, the third switch set comprises a seventh TFT switch, an eighth TFT switch and a ninth TFT switch, the control lines comprises a first control line, a second control line and a third control line, and the scan lines comprises a first scan line, a second scan line and a third scan line;

wherein the control lines connecting to at least one of the switches of each of the switch sets individually is that:

the first control line is connected to a gate electrode of the first TFT switch and a source electrode of the second TFT switch, the second control line is connected to a gate electrode of the second TFT switch and a source electrode of the third TFT switch, and the third control line is connected to a gate electrode of the third TFT switch;

the first control line is connected to a gate electrode of the fifth TFT switch, the second control line is connected to a gate electrode of the fourth TFT switch, a source electrode of the fifth TFT switch and a source electrode of the sixth TFT switch, and the third control line is connected to a gate electrode of the sixth TFT switch; and the first control line is connected to a gate electrode of the ninth TFT switch, the second control line is connected to a gate electrode of the eighth TFT switch, and the third control line is directly connected to a gate electrode of the seventh TFT switch, a source electrode of the eighth TFT switch and a source electrode of the ninth TFT switch.

2. The scan driving circuit according to claim 1, wherein the fan-out line connecting to the scan lines through the switch sets is that:

the fan-out line is connected to a source electrode of the first TFT switch, a drain electrode of the first TFT switch is connected to a drain electrode of the second TFT switch, the drain electrode of the second TFT switch is connected to a drain electrode of the third TFT switch, and the drain electrode of the third TFT switch is connected to the first scan line;

the fan-out line is connected to a source electrode of the fourth TFT switch, a drain electrode of the fourth TFT switch is connected to a drain electrode of the fifth TFT switch, the drain electrode of the fifth TFT switch is connected to a drain electrode of the sixth TFT switch, and the drain electrode of the sixth TFT switch is connected to the second scan line; and the fan-out line is connected to a source electrode of the seventh TFT switch, a drain electrode of the seventh TFT switch is connected to a drain electrode of the eighth TFT switch, the drain electrode of the eighth TFT switch is connected to a drain electrode of the ninth TFT switch, and the drain electrode of the ninth TFT switch is connected to the third scan line.

3. The scan driving circuit according to claim 2, wherein when the fan-out line outputs a high level signal in a first clock cycle, a second clock cycle and a third clock cycle, the first control line outputs the high level signal in the first clock cycle and outputs a low level signal in the second and third clock cycles, the second control line outputs the low level signal in the first and third clock cycles and outputs the high level signal in the second clock cycle, and the third control line outputs the low level signal in the first and second clock cycles and outputs the high level signal in the third clock cycle, such that the first scan line is turned on in the first clock cycle and turned off in the second and third clock cycles, the second scan line is turned off in the first clock cycle, turned on in the second clock cycle and turned off in the third clock cycle, and the third scan line is turned off in the first and second clock cycles and turned on in the third clock cycle.

4. A display panel comprising a plurality of gate driving chips and a scan driving circuit, wherein:

the scan driving circuit comprises a plurality of scan driving units, wherein each of the scan driving units comprises a fan-out line, a plurality of switch sets, a plurality of control lines and a plurality of scan lines, and an amount of the switch sets, an amount of switches in each of the switch sets, an amount of the control lines and an amount of the scan lines are the same;

the control lines are connected to at least one of the switches of each of the switch sets individually;

the fan-out line is connected to the scan lines through the switch sets, and the switch sets are correspondence to the scan lines one-on-one, such that the scan lines are turned on separately under control of the fan-out line and the control lines;

the gate driving chips are connected to the fan-out lines of the scan driving units individually, and the gate driving chips are correspondence to the fan-out lines one-on-one, wherein the switch sets comprise a first switch set, a second switch set and a third switch set; the first switch set comprises a first TFT switch, a second TFT switch and a third TFT switch, the second switch set comprises a fourth TFT switch, a fifth TFT switch and a sixth TFT switch, the third switch set comprises a seventh TFT switch, an eighth TFT switch and a ninth TFT switch, the control lines comprises a first control line, a second control line and a third control line, and the scan lines comprises a first scan line, a second scan line and a third scan line;

wherein the control lines being connected to at least one of the switches of each of the switch sets individually is that:

the first control line is connected to a gate electrode of the first TFT switch and a source electrode of the second TFT switch, the second control line is connected to a gate electrode of the second TFT switch and a source electrode of the third TFT switch, and the third control line is connected to a gate electrode of the third TFT switch;

the first control line is connected to a gate electrode of the fifth TFT switch, the second control line is connected to a gate electrode of the fourth TFT switch, a source electrode of the fifth TFT switch and a source electrode of the sixth TFT switch, and the third control line is connected to a gate electrode of the sixth TFT switch; and the first control line is connected to a gate electrode of the ninth TFT switch, the second control line is connected to a gate electrode of the eighth TFT switch, and the third control line is directly connected to a gate electrode of the seventh TFT switch, a source electrode of the eighth TFT switch and a source electrode of the ninth TFT switch.

5. The display panel according to claim 4, wherein the fan-out line connecting to the scan lines through the switch sets is that:

the fan-out line is connected to a source electrode of the first TFT switch, a drain electrode of the first TFT switch is connected to a drain electrode of the second TFT switch, the drain electrode of the second TFT switch is connected to a drain electrode of the third TFT switch, and the drain electrode of the third TFT switch is connected to the first scan line;

the fan-out line is connected to a source electrode of the fourth TFT switch, a drain electrode of the fourth TFT switch is connected to a drain electrode of the fifth TFT switch, the drain electrode of the fifth TFT switch is connected to a drain electrode of the sixth TFT switch, and the drain electrode of the sixth TFT switch is connected to the second scan line; and the fan-out line is connected to a source electrode of the seventh TFT switch, a drain electrode of the seventh TFT switch is connected to a drain electrode of the eighth TFT switch, the drain electrode of the eighth TFT switch is connected to a drain electrode of the ninth TFT switch, and the drain electrode of the ninth TFT switch is connected to the third scan line.

6. The display panel according to claim 5, wherein when the fan-out line outputs a high level signal in a first clock cycle, a second clock cycle and a third clock cycle, the first control line outputs the high level signal in the first clock cycle and outputs a low level signal in the second and third clock cycles, the second control line outputs the low level signal in the first and third clock cycles and outputs the high level signal in the second clock cycle, and the third control line outputs the low level signal in the first and second clock cycles and outputs the high level signal in the third clock cycle, such that the first scan line is turned on in the first clock cycle and turned off in the second and third clock cycles, the second scan line is turned off in the first clock cycle, turned on in the second clock cycle and turned off in the third clock cycle, and the third scan line is turned off in the first and second clock cycles and turned on in the third clock cycle.

* * * * *